US005302021A

United States Patent [19]

Jennett et al.

[11] Patent Number: 5,302,021

[45] Date of Patent: Apr. 12, 1994

[54] METHOD OF PREVENTING THE FORMATION OF AN AIR POCKET IN A BLENDER

[75] Inventors: David Jennett, Olmsted Township, Cuyahoga County; Richard D. Boozer, Columbia Station; John K. Barnard, Bay Village, all of Ohio

[73] Assignee: Vita-Mix Corporation, Cleveland, Ohio

[21] Appl. No.: 59,954

[22] Filed: May 13, 1993

Related U.S. Application Data

[63] Continuation of Ser. No. 860,892, Mar. 31, 1992, abandoned.

[51] Int. Cl.[5] ..... B01F 15/00

[52] U.S. Cl. ..... 366/348; 366/314; 366/349; 81/488; 241/30

[58] Field of Search ..... 366/129, 130, 197, 205, 366/242, 244, 245, 247, 249, 314, 347, 348, 349; 99/646 C; 15/105; D7/378, 413, 414, 665, 682, 688; 294/1.1; 81/488; 241/25, 30, 169.2, 199.12, 282.1, 282.2; 100/95-97, 295

[56] References Cited

U.S. PATENT DOCUMENTS

| | | | |
|---|---|---|---|
| D. 269,471 | 6/1983 | Auerbach | D7/682 X |
| 1,412,536 | 4/1922 | Mayer | 241/169.2 X |
| 2,066,997 | 1/1937 | Mueller | 81/488 |
| 2,785,547 | 3/1957 | Barros | 241/282.1 X |
| 3,088,345 | 5/1963 | Campbell | 241/245 X |
| 3,107,711 | 10/1963 | Azmus | D7/414 X |
| 3,346,029 | 10/1967 | Harris, Jr. | 241/282.2 X |
| 3,417,972 | 12/1968 | Vincent | 366/242 X |
| 3,427,636 | 2/1969 | Seifert | 15/105 |
| 3,765,275 | 10/1973 | Johnson | 81/488 |
| 3,780,393 | 12/1973 | Gaetke | 15/105 |
| 3,895,548 | 7/1975 | Sauve | 241/169.2 X |
| 4,137,578 | 2/1979 | Felici | 15/105 X |
| 4,250,771 | 2/1981 | Berler | 241/282.1 X |
| 4,268,080 | 5/1981 | Lindley | 15/105 X |
| 4,395,792 | 8/1983 | Cosner | 15/105 |
| 4,397,427 | 8/1983 | Howard | 241/282.1 X |
| 4,561,782 | 12/1985 | Jacobsen et al. | 366/349 |

FOREIGN PATENT DOCUMENTS

| | | | |
|---|---|---|---|
| 187260 | 10/1956 | Austria | 241/199.12 |

OTHER PUBLICATIONS

Vita-Mix Corporation, 8615 Usher Road, Cleveland, Ohio 44138, 1 page of an instruction manual, undated.

*Primary Examiner*—Harvey C. Hornsby
*Assistant Examiner*—Charles Cooley
*Attorney, Agent, or Firm*—Renner, Kenner, Grieve, Bobak, Taylor & Weber

[57] ABSTRACT

An air pocket is often formed in fluid (F) in the pitcher (14) of a blender around the rotating mixing blade assembly (24) thereof. The air pocket is of a cross-sectional size defined by an air channel defining member, shown in the form of a bearing housing (23) of the mixing blade assembly (24). After the pitcher (14) is filled with the fluid (F), the plunger portion (12) of an accessory (10) is positioned adjacent to and above the mixing blade assembly (24) and maintained free of contact with the pitcher (14). the plunger portion (12) is of a cross-sectional size approximately the cross-sectional size of the air channel defining member and prevents the formation of the air pocket in the fluid (F) around the blade assembly (24).

1 Claim, 1 Drawing Sheet

METHOD OF PREVENTING THE FORMATION OF AN AIR POCKET IN A BLENDER

This application is a continuation of application Ser. No. 07/860,892, filed Mar. 31, 1992 now abandoned.

TECHNICAL FIELD

The present invention relates to an accessory for use with a blender. More particularly, the present invention relates to a device which can be inserted into a high speed liquid food blender which prohibits the formation of a dead space or air pocket often formed in such blenders around the mixing blades, which dead space prohibits proper mixing.

BACKGROUND ART

High speed liquid food blenders most often utilize propeller-like blades to pulverize and otherwise mix the food being processed. In normal operation the food is circulated down to and past the blades for processing, and as long as the circulation pattern is consistent and uniform, efficient pulverization and mixing takes place.

However, particularly when mixing thicker, more viscous liquids, a channel of air is often formed extending from above the blades to the top of the blender, much as in a whirlpool effect. As the channel of air is drawn to the blades, an air bubble or dead air space is eventually formed around the blades which prohibits the food being processed from contacting the blades and thereby rendering the blades ineffective to mix the food. Presently, this can only be corrected by manually stirring the food to disperse the air pocket away from the blades. However, the air pocket will usually readily reappear thus making the blending process not only inefficient but also bothersome to the user.

DISCLOSURE OF THE INVENTION

It is thus a primary object of the present invention to provide a plunger accessory for a blender which prevents the formation of a dead air space around the mixing blades of the blender.

It is another object of the present invention to provide a plunger accessory, as above, which cannot interfere with the blades of the blender while eliminating the dead air space.

It is a further object of the present invention to provide a plunger accessory, as above, which can be utilized to prevent the dead air space without the constant attention of the user.

It is an additional object of the present invention to provide a plunger accessory, as above, which can also be used to stir the food material being processed.

These and other objects of the present invention, as well as the advantages thereof over existing prior art forms, which will become apparent from the description to follow, are accomplished by the improvements hereinafter described and claimed.

In general, the blender accessory according to the present invention includes a plunger portion having a stop member positioned near the top thereof. The plunger is received through an opening in the cover of a blender and into the blender pitcher therebelow. The stop member rests on the cover and the plunger is of a predetermined length so that the bottom thereof is just above a mixing blade assembly positioned near the bottom of the pitcher. The blade assembly has an air channel defining member, such as a bearing housing, and the size of the plunger approximates that of the bearing housing to close off the air channel and thereby prevent the formation of an air pocket which would otherwise be formed as the blade assembly mixes the fluid food in the pitcher.

A preferred exemplary plunger accessory for a blender incorporating the concepts of the present invention is shown by way of example in the accompanying drawings without attempting to show all the various forms and modifications in which the invention might be embodied, the invention being measured by the appended claims and not by the details of the specification.

REFERRED EMBODIMENT FOR CARRYING OUT THE INVENTION

Figure 1:
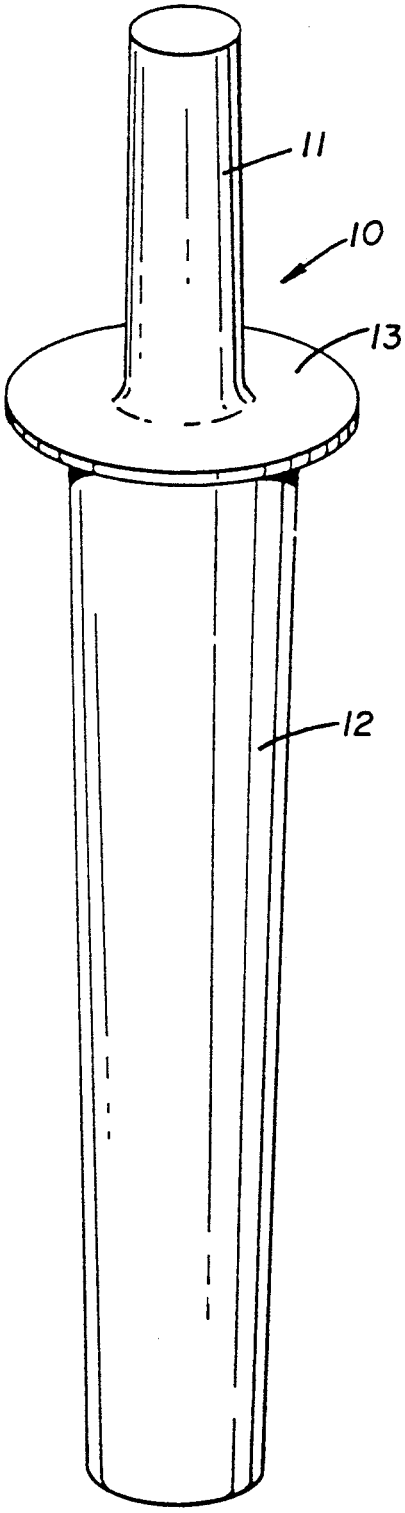
FIG. 1 is a perspective view of a plunger accessory for a blender constructed in accordance with the concepts of the present invention.

A plunger accessory for a blender is indicated generally by the numeral 10 and is shown as including a generally cylindrical handle portion 11, and a generally cylindrical plunger portion 12 separated by an enlarged generally circular shoulder or stop member 13. As will hereinafter become evident, plunger portion 12 need not be cylindrical but rather could take on any suitable geometric shape. Moreover, while stop member 13 is shown as being a generally circular disk, it could be of any other configuration which performs the stop function, to be hereinafter described, the disk shape being preferred because that shape enables stop member 13 to perform the additional function of closing the top of the blender.

Plunger 10 can be formed of any suitable rigid material, such as plastic, and handle 11 and plunger portion 12 may be tapered, as shown, to facilitate the molding process. Handle 11 may be of any desired length convenient for facile gripping by the user; however, as will be hereinafter described, the length of plunger portion 12 should be such that when positioned in a blender, such as shown in FIG. 2, the bottom thereof will not interfere with the blender blades.

Figure 2:
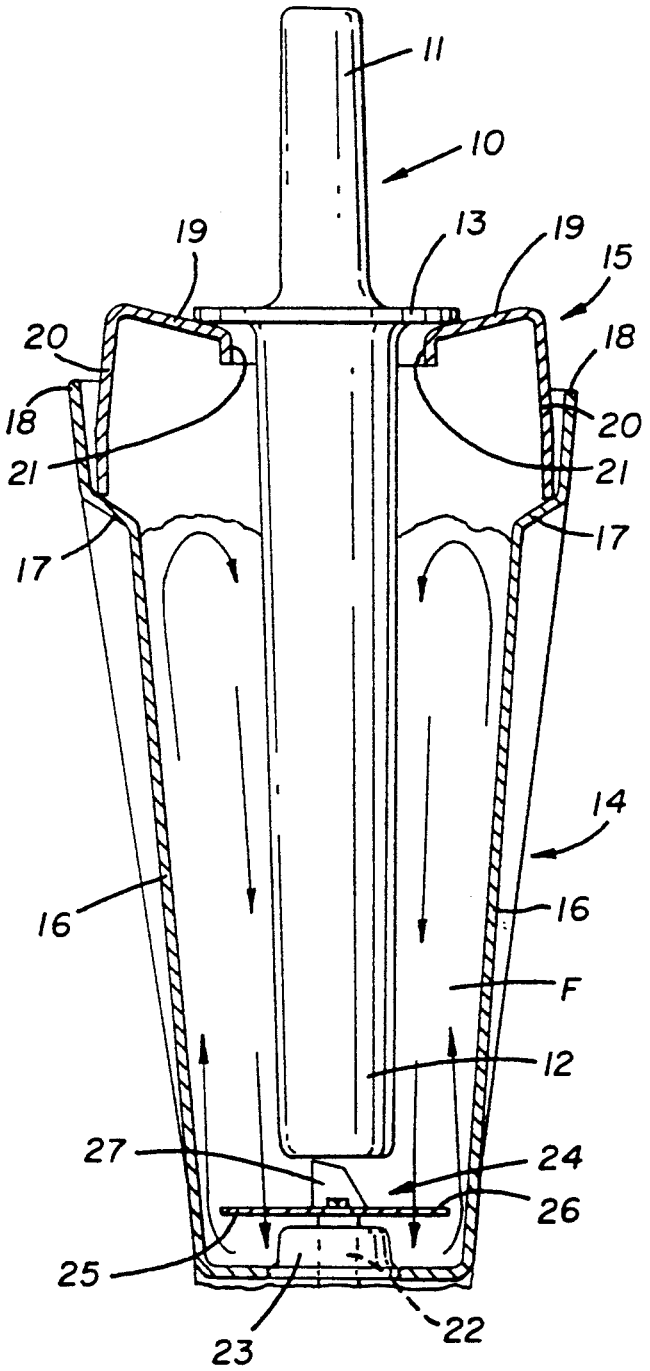
FIG. 2 is a sectional view of a portion of a blender showing the plunger accessory in use therein.

With reference to FIG. 2, some of the components of a typical blender are shown therein which include a pitcher portion generally indicated by the numeral 14 which holds the fluid F to be mixed, and a cover portion generally indicated by the numeral 15. Pitcher 14 can be of any conventional configuration and is shown as having tapered cylindrical side walls 16 and an upper shoulder 17 extending outwardly to form an enlarged upper lip 18. Similarly, cover 15 can be of any conventional configuration and is shown as including a top portion 19 having a skirt 20 extending downwardly therefrom. The bottom of skirt 20 rests on the upper shoulder 17 of pitcher 14 to close the top of pitcher 14. Top portion 19 of cover 15 is provided with a central aperture 21 which, if desired, may be closed by a dome plug (not shown) for certain applications of the blender.

A motor driven shaft 22 extends upwardly through a bearing housing 23 into the bottom of pitcher 14 and carries a mixing blade assembly generally indicated by the numeral 24. Blade assembly 24 can be of any conventional configuration with the blade assembly 24 shown including four circumferentially spaced propeller-like blades, only two being shown as numerals 25 and 26. At least some of the blades may be provided with upturned blade members, such as member 27 shown in FIG. 2.

In operation, with pitcher 14 filled with fluid material F to be processed and with cover 15 in place, the motor (not shown) is actuated to rotate mixing blades 24. As such, the fluid is drawn between the propeller-like blades and circulates back up to the upper surface. In the absence of the plunger accessory 10, and in particular when processing viscous fluids, such action may tend to form an air channel extending from the blades to the top of the fluid much like a whirlpool. Eventually, an air pocket will form around the blades which renders the blades ineffective for a total blending of the fluid. The air channel which forms above the blades is usually of a size dictated by the air channel forming member of the blade assembly. For the particular blade assembly shown, bearing housing 23 dictates the size of the air channel which is thus of a diameter of approximately the size of bearing housing 23. For other types of mixing blades, such as ones having a central hub from which the blades extend, the size of the air channel is dictated by that hub and is thus usually of a diameter of the central hub.

Plunger accessory 10 prevents the deleterious formation of such an air channel and thereby prohibits the ultimate formation of an air pocket around the blades. As shown in FIG. 2, plunger portion 12 of accessory 10 is inserted through cover aperture 21 with stop disk 13 resting on cover top portion 19. This not only closes cover 15 but also limits the downward extent of plunger portion 12. As such, plunger portion 12 is designed to be of a length so as to be positioned just above the mixing blade assembly 24 when positioned in the blender. Thus, the length of plunger portion 12 is dictated by the size of the blender being employed.

The diameter of at least the bottom of plunger portion 12 is also important to carrying out the advantages of the present invention. Basically, it is preferably of a size approximately equal to the air channel defining parameter of the blender. Thus, for the blender shown in FIG. 2, it is designed to be of a size approximately equal to the size of bearing housing 23. In actual practice, it has been found that if the size of the bottom of plunger portion 12 is ±25% of the size of the air channel defining member, neither the channel nor the eventual air pocket will be able to be formed. Thus, as shown in FIG. 2, when the blender is operating the fluid is properly circulated along the side of plunger 12, through the blades, around the outer tips of the blades, and back to the top as shown by the arrows. Thus, the potential for forming the deleterious air pocket around and above the mixing blade is eliminated.

Plunger accessory 10 can also be utilized by the user as a stirring mechanism. If additional stirring is desired, one need only grasp handle portion 11 and oscillate plunger accessory 10 to move plunger portion 12 from side to side within pitcher 14 to create the additional stirring desired.

It should thus be appreciated that a plunger accessory constructed and utilized as described herein accomplishes the objects of the present invention and otherwise substantially improves the fluid food blending and processing art.

We claim:

1. A method of preventing the formation of an air pocket around rotating blades positioned in a pitcher of a blender, the air pocket being created from an air channel of a cross-sectional size defined by a member associated with the blades, comprising the steps of supplying a fluid into the pitcher, and positioning a plunger, having a cross-sectional size approximating the cross-sectional size of the member, adjacent to and above the rotating blades while maintaining the plunger free of contact with the pitcher thereby preventing the formation of an air pocket in the fluid around the rotating blades.

* * * * *

UNITED STATES PATENT AND TRADEMARK OFFICE

CERTIFICATE OF CORRECTION

PATENT NO. : 5,302,021

DATED : April 12, 1994

INVENTOR(S) : David Jennett, Richard D. Boozer, John K. Barnard and Jack M. Byrne It is certified that error appears in the above-identified patent and that said Letters Patent are hereby corrected as shown below:

Cover page, [75], Inventors: following "John K. Barnard, Bay Village" insert --and Jack M. Byrne, Westlake--.

[57], Abstract, line 10, "the" (second occurrence) should read --The--.

[57], Abstract, line 11, "approximately" should read --approximating--.

Column 2, line 21, "REFERRED" should read --PREFERRED--.

Signed and Sealed this

Twenty-seventh Day of September, 1994

*Attest:*

Bruce Lehman

BRUCE LEHMAN

*Attesting Officer*

*Commissioner of Patents and Trademarks*